United States Patent [19]

Sasano

[11] 3,970,060

[45] July 20, 1976

[54] FUEL CONTROL APPARATUS

[75] Inventor: Mitunori Sasano, Toyota, Japan

[73] Assignee: Toyota Jidosha Kogyo Kabushiki Kaisha, Japan

[22] Filed: Nov. 19, 1974

[21] Appl. No.: 525,188

[30] Foreign Application Priority Data

Apr. 10, 1974 Japan ..... 49-40477

[52] U.S. Cl. ..... 123/119 R; 261/DIG. 19; 123/127

[51] Int. Cl.[2] ..... F02M 7/00

[58] Field of Search ..... 123/119 R, 127, 59 PC; 261/DIG. 19, 69 A, 69 R

[56] References Cited

UNITED STATES PATENTS

| | | | |
|---|---|---|---|
| 2,993,485 | 7/1961 | Cornelius | 261/DIG. 19 |
| 3,336,012 | 8/1967 | Walker | 123/127 |
| 3,608,532 | 9/1971 | Balluff | 261/DIG. 19 |
| 3,664,313 | 5/1972 | Walker | 123/127 |

*Primary Examiner*—Charles J. Myhre
*Assistant Examiner*—R. H. Lazarus
*Attorney, Agent, or Firm*—Kenyon & Kenyon

[57] ABSTRACT

A fuel control apparatus for controlling the flow amount of fuel delivered from a carburetor having a power circuit is disclosed, in which the fuel passage of the power circuit permits the fuel in a float chamber of the carburetor from flowing toward the fuel nozzles of the carburetor in response to the reduction in the vacuum led into a vacuum chamber of the carburetor from a vacuum reservation tank in which the vacuum introduced from an intake manifold of a gasoline engine is reserved. The vacuum reservation tank has a considerable volumetric space therein defined by a sealed housing, and is disposed to the exterior of the carburetor. The fuel control apparatus also comprises a means for causing reduction in the vacuum developing in a vacuum region between the vacuum reservation tank and the vacuum chamber of the carburetor.

4 Claims, 6 Drawing Figures

FUEL CONTROL APPARATUS

DESCRIPTION OF THE INVENTION

The present invention relates to an apparatus for controlling the amount of fuel delivered from a carburetor to a gasoline engine, and more particularly relates to the apparatus provided for a carburetor of the type having a power circuit therein, for the general purpose of raising the specific fuel consumption of, and reducing the harmful emissions from gasoline engines.

One apparatus for controlling the amount of fuel from a carburetor having a power circuit for enriching the air-fuel mixture during full-power operation of gasoline engines, has already been made known, i.e., in the known apparatus, a metering valve is provided for controlling the flow amount of fuel from the carburetor through controlling the opening amount of the fuel passageway in the carburetor in response to change in degree of the vacuum within a vacuum chamber of the carburetor, and also the vacuum chamber is connected to the intake manifold through a vacuum pipe line disposed to run to the exterior of the carburetor so that the degree of the vacuum in the vacuum chamber of the carburetor is controlled by the vacuum prevailing in the intake-manifold, which in turn changes with any alteration in the operating condition of the engine. However, the weakness of the known fuel control apparatus lies in that during the first stage of ordinary acceleration of an engine, from a starting position, the power circuit is brought into operation when it is not yet required, and as a result, excessive fuel flows into the engine thereby increasing the fuel consumption and unburnt gases in the exhaust gases. This is because, the slow speed of the engine during acceleration from a starting position cannot produce an intake manifold vacuum sufficient for preventing the operation of the power circuit, in spite of the fact that the opening of the throttle valve is kept small.

The principal object of the present invention is to eliminate the above-mentioned incompleteness encountered by the known fuel control apparatus for a carburetor having a power circuit therein.

A further object of the present invention is to provide a fuel control apparatus which is able to control the amount of fuel delivered from the carburetor through detection of the temperature of the engine, e.g. the water coolant temperature in, for example a gasoline engine as well as detection of changes in the operating condition of the engine.

In accordance with the present invention, a fuel control apparatus for controlling the flow amount of fuel delivered from a carburetor having a power circuit including a fuel passage which permits the fuel in a float chamber to flow toward fuel nozzles of the carburetor in response to a reduction in the vacuum developed in a vacuum chamber of the carburetor by the vacuum of an intake manifold of a gasoline engine comprises a vacuum reservation tank for reserving the vacuum from the intake manifold through a vacuum pipe line interconnecting therebetween, and for delivering the vacuum reserved therein to the vacuum chamber of the carburetor by way of another vacuum pipe line, the vacuum reservation tank including a valve means capable of interrupting the interconnection between the intake manifold and the vacuum reservation tank when the vacuum in said intake manifold is smaller than the vacuum reserved in said vacuum reservation tank, and; means for causing the reduction in the vacuum developing in a vacuum region defined between the vacuum reservation tank and the vacuum chamber, at an adjusted slow rate, the vacuum reduction means being disposed in the vacuum region.

The above-defined fuel control apparatus may further comprise a three way valve for establishing first and second vacuum circuits alternately shiftable to one another, the first vacuum circuit being interconnectable between the vacuum chamber and the vacuum reservation tank, the second vacuum circuit being directly interconnectable between the vacuum chamber and the intake manifold, and the alternate shifting of the two vacuum circuits being actuated in response to the operating condition of the gasoline engine.

The present invention will now be explained in detail in conjunction with the specific embodiments thereof, shown in the accompanying drawings wherein.

Figure 1:
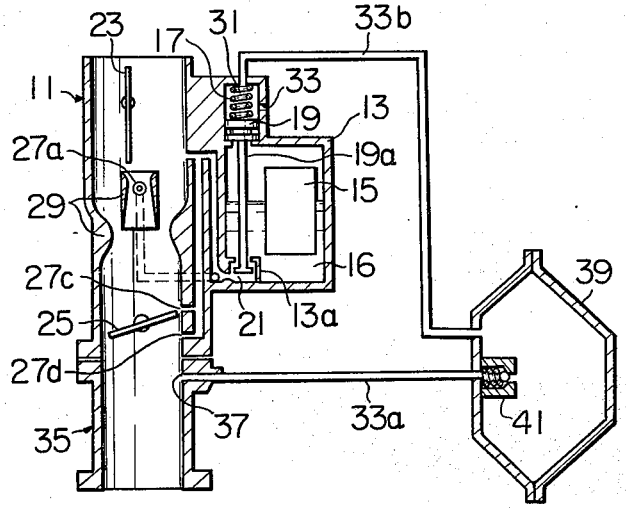
FIG. 1 is a cross-sectional schematic view of an embodiment of a fuel control apparatus for a carburetor according to the present invention.

Referring to FIG. 1 which shows one preferable embodiment of a fuel control apparatus for a carburetor according to the present invention, reference numeral 11 designates a carburetor into which the air flows through an air cleaner assembly (not shown in FIG. 1). The air subsequently flows toward an intake manifold 35 by way of a choke valve 23, venturi 29 and a throttle valve 25. Carburetor 11 is provided with a float chamber 13 in which a predetermined amount of fuel 16 is always reserved. A float mechanism designated by reference numeral 15 operates to maintain a constant level of fuel reserved in the float chamber 13. The carburetor 11 is also provided with a vacuum chamber 17 in which a piston 19, continually under the downward depressing force of a spring 31, is mounted to move up and down. A piston rod **19*a* extending downwardly from the piston 19 is provided, at its lowermost end, with a known metering valve 21 which cooperates with a valve seat 13*a* so as to control the opening or closing of the fuel passageway formed between the valve 21 and the valve seat 13*a*. That is to say, the opening amount of the fuel passageway is controlled by the position taken by valve 21 with respect to the valve seat 13*a*. The carburetor 11 is further provided with a main nozzle 27*a* together with idle or low speed ports 27*c* and 27*d***, which are all formed in the internal wall of the carburetor.

The intake manifold 35 is provided with a port 37 opening toward the interior thereof. From this port 37, a vacuum pipe line **33*a* extends towards the exterior of the carburetor so as to be connected to a vacuum reservation tank 39 to which the other vacuum pipe line 33*b* extending from the vacuum chamber 17** is connected. Thus, if the vacuum in the intake manifold increases so that the pressure within the vacuum reservation tank 39 becomes higher than the pressure in the intake manifold 35, the differential pressure between both pressures acts to open a check valve 41 of the vacuum reservation tank 39 so as to interconnect the intake manifold 35 and the vacuum reservation tank 39. As a result, the absolute pressure within the vacuum reservation tank 39 falls so that the degree of vacuum in the vacuum reservation tank 39 becomes substantially equal to the degree of the vacuum in the intake manifold 35. If the vacuum in the intake manifold 35 is reduced (i.e. the aboslute pressure in the intake manifold 35 approaches to the atmospheric pressure) to a predetermined degree, the check valve 41 is closed so that even if the vacuum in the intake manifold 35 is reduced, the leakage of the vacuum from the vacuum reservation tank 39 into the intake manifold 35 is prevented. It should be noted that in the embodiment of FIG. 1, an orifice 33 is formed in one part of the side wall of a vacuum chamber 17. This orifice 33 serves to enable a gradual reduction in the vacuum in the vacuum chamber 17 due to the leakage of the vacuum through the orifice 33 into the atomosphere. It should be appreciated that appropriate selection of the diameter of the orifice 33 will permit selection of an appropriate rate of reduction in the vacuum in the vacuum chamber 17. The gradual reduction in the vacuum within the vacuum chamber 17 will, of course, cause gradual reduction in the vacuum in the vacuum pipe line 33*b* and the vacuum reservation tank 39 while the check valve 41 is closed. It should be appreciated that in accordance with the present invention, the vacuum reservation tank 39 is disposed in a vacuum region interconnecting the intake manifold 35 and the vacuum chamber 17 of the carburetor 11, and with this disposition of the vacuum reservation tank 39, the reduction in the vacuum of the intake manifold 35 does not immediately affect the vacuum reduction in the vacuum chamber 17 of the carburetor 11. More specifically, when the vacuum in the intake manifold 35 is sufficiently increased, the check valve 41 of the vacuum reservation tank 35 is opened and, as a result, the vacuum in the intake manifold 35 is led into the vacuum reservation tank 39 through the vacuum pipe line 33*a* so that the tank 39 is filled with the vacuum. On the other hand, if the vacuum in the intake manifold 35 is reduced and if the differential vacuum between the intake manifold 35 and the tank 39 approaches a predetermined value, the check valve 41 is automatically closed and, as a result, the vacuum reservation tank 39 continues to retain the full capacity of the vacuum and, moreover, since the vacuum in the tank 39 passes to the vacuum chamber 17 of the carburetor 11 through the vacuum pipe line 33*b*, the vacuum in the vacuum chamber 17 may diminish at a gradual rate through the orifice 33.

The operation of the apparatus for controlling the fuel delivered from the carburetor shown in FIG. 1 will be explained referring to FIGS. 2A through 2C.

Figure 2A:
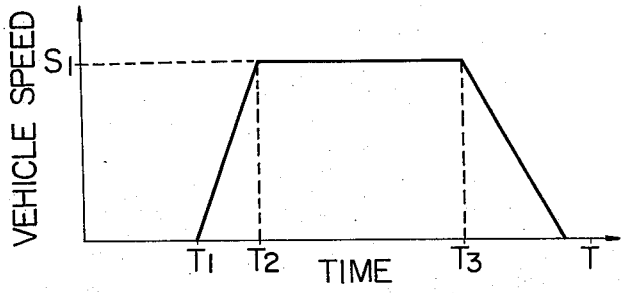
FIGS. 2A, 2B and 2C are diagrams illustrating the operation of, and the advantageous effects attained by, a fuel control apparatus for a carburetor according to the present invention, on the basis of comparison between the present invention and the prior art.
Figure 2B:
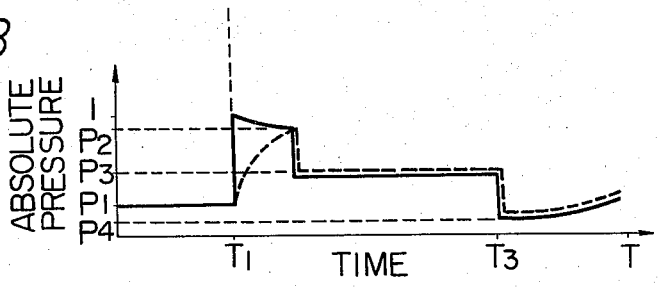
Figure 2C:
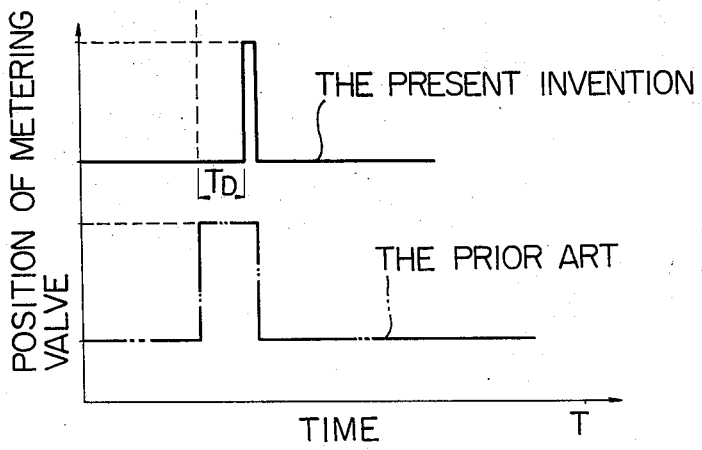

FIG. 2A is a diagram illustrating the typical operation modes of a vehicle in which the ordinate shows the speed of the vehicle, and the abscissa shows the lapse of time. FIG. 2B is a diagram illustrating how the absolute pressures in the intake manifold 35 and the vacuum reservation tank 39 change with the lapse of time when the vehicle takes the operation modes shown in FIG. 2A. FIG. 2C is a diagram enabling comparison of the positions taken by the metering valve 21 in the cases where, (1) a vehicle having a fuel control apparatus of the present invention mounted thereon takes the operation modes as shown in FIG. 2A and (2) another vehicle which has the fuel control apparatus of the prior art, follows the same operation modes shown in FIG. 2A. In FIG. 2C, the case of the vehicle with a fuel control apparatus of the present invention is identified as "The Present Invention," while the case of the vehicle without a fuel control apparatus of the present invention is identified as "The Prior Art."

Referring now to FIG. 2A, the idling mode during which the engine of the vehicle is in an idling operation and the speed of the vehicle is kept at zero, continues to the time T1, at which time, the acceleration mode during which the vehicle is started and continuously accelerated, begins and continues until the time T2 when the speed of the vehicle reaches a high speed S1. In the subsequent high speed mode the vehicle continuously runs at this high speed S1 during a time period of T2 through T3. From the time T3, the deceleration mode starts, during which the vehicle is decelerated until its speed reaches zero, i.e., the vehicle stops. As is well known, during the idling mode the engine speed is kept very low and the throttle valve 25 is almost closed. Therefore, the absolute pressure within the intake manifold 35 is low, and the vacuum in the intake manifold 35 is increased to the value P1. When the vehicle starts to run at the time T1, the throttle valve 25 of the carburetor 11 opens rapidly in response to the accelerator pedal (not shown in FIG. 1) of the vehicle. However, at this instant, the engine speed cannot be immediately increased. Thus, the suction force due to the operation of the engine is weak and, as a result, the vacuum in the intake manifold 35 is reduced so that the absolute pressure in the intake manifold 35 rapidly approaches atmospheric pressure. Then, in response to the increase in engine speed, the suction force is gradually increased. Thus, the vacuum in the intake manifold 35 increases during the time from T1 to T2 so that the absolute pressure within the intake manifold 35 falls to P2, shown in FIG. 2B. In connection with changes in the absolute pressure within the intake manifold 35 during said time period between T1 and T2, it should be noted that the change in the vacuum within the vacuum reservation tank 39 during said time period is quite different from that of the intake manifold 35, due to the operation of the check valve 41. In FIG. 2B, a curve shown by a broken line indicates the changes in the vacuum within the vacuum reservation tank 39 with the lapse of time. From this curve, it will be understood that during the time period between T1 and T2, the change in the vacuum in the vacuum reservation tank 39 is subject to a time delay, relative to changes in the vacuum in the intake manifold 35. The occurence of this delay results from the fact that the vacuum reservation tank 39 is provided with a considerable volumetric space for storing the vacuum therein, and also, the vacuum within the tank 39 can be prevented from leaking into the intake manifold 35. However, the vacuum pressure in the vacuum reservation tank is gradually reduced to pressure P2 due to leakage from the orifice 33. Now, during the time period between T2 and T3, where the operation mode of the vehicle is in a constant high speed one, the throttle valve 25 is closed so as to allow for the constant high speed running of the vehicle, and as a result, the absolute pressure within the intake manifold 35 is maintained at a constant degree of vacuum corresponding to the pressure P3 shown in FIG. 2B. This vacuum is introduced into the vacuum reservation tank 39 due to opening of the check valve 41. Thus, the vacuum corresponding to the pressure P3 prevails in the vacuum pipe lines 33*a*, 33*b*, the vacuum chamber 17 of the carburetor 11, as well as the vacuum reservation tank 39. It should be understood that during the constant high speed running of the vehicle, the vacuum in the intake manifold 35 is continuously fed into the vacuum reservation tank 39, and therefore, the vacuum chamber 17 of the carburetor 11 is always supplied with the vacuum from the vacuum reservation tank 39, so compensating for leakage of the vacuum in the vacuum chamber 17 from the orifice 33. Subsequently, when the vehicle enters its decelerating operation mode at the time T3, the throttle valve 25 of the carburetor 11 is closed further, although a high engine speed if maintained at the beginning of the decelerating operation mode of the vehicle. Thus, the vacuum in the intake manifold 35 rapidly increases, i.e., the absolute pressure in the intake manifold reduces from P3 to P4. The vacuum in the vacuum reservation tank 39 is, then, rapidly increased from P3 to P4, since the check valve 41 is kept open by the vacuum coming from the intake manifold 35, so that the vacuum reservation tank 39 is interconnected with the intake manifold 35 through the vacuum pipe line 33*a*.

The operation of the metering valve 21 of the carburetor 11 will be described referring to FIG. 2C, in connection with the above-described changing processes of the vacuum in the intake manifold 35 and the vacuum reservation tank 39.

As was previously described, the metering valve 21 is so constructed that it is able to move up and down by the action of the piston 19 mounted in the vacuum chamber 17. If the vacuum in the vacuum chamber 17 is sufficiently increased, the piston 19 receives suction force upward, in reaction against the downward depressing force exerted by the spring 31, since the float chamber 13 is always vented toward the atmosphere so that the atmospheric pressure always prevails in the float chamber 13. The upward force causes the piston 19, together with the metering valve 21, to move in the upward direction in FIG. 1. As a result, the metering valve 21 takes a position bearing against the valve seat 13*a* so as to close the fuel passageway between the valve 21 and the valve seat 13*a*. Also, if the vacuum in the vacuum chamber 17 approaches zero, i.e., if the absolute pressure within the chamber 17 increases to the atmospheric pressure, the piston 19 is only depressed downwards by the spring 31. As a result, the piston 19 moves in the downward direction so as to remove the valve 21 from the seat 13*a* thereby opening the fuel passageway between the metering valve 21 and the valve seat 13*a*. However, from the fact that the metering valve 21 takes position such that it establishes the fuel passageway when the vacuum in the vacuum chamber 17 approaches zero (i.e. the atmospheric pressure), it should be understood that when the metering valve 21 operates so as to cause the opening of the fuel passageway, the vacuum which has developed in the vacuum pipe line 33*b* and the vacuum reservation tank 39 interconnected with the vacuum chamber 17 by the vacuum pipe line 33*b*, also approaches zero. It should now be understood that in the fuel control apparatus of the present invention, provision of the vacuum reservation tank 39 having a considerable volumetric space therein to allow for reservation of the vacuum, as well as provision of the orifice 33 for permitting a considerably slow leakage of the vacuum from the vacuum chamber 17, causes a predetermined time delay $T_D$ shown in FIG. 2C in the operation of the metering valve 21 for establishing the fuel passageway, compared with the case identified by "The Prior Art" in FIG. 2C, where the vacuum reservation tank 39 and the orifice 33 are not provided for the fuel control apparatus for a carburetor. The comparison will now be made between the operation mode of the vehicle, as shown in FIG. 2A and the position of the metering valve 21, as shown in FIG. 2C. In the fuel control apparatus of the present invention, the metering valve 21 takes a position closing the fuel passageway between the valve 21 and the valve seat 13*a* from the beginning of the accelerating operation mode of the vehicle to the time when the vacuum in the vacuum reservation tank 39 comes close to the pressure P2. That is to say, the valve 21 takes a position opening the fuel passageway after the lapse of the time interval $T_D$ from the time T1. When the fuel passageway between the metering valve 21 and the valve seat 13*a* is opened, the fuel supply from the carburetor 11 toward the intake manifold 35 is increased, i.e. the air-fuel mixture is enriched. From the foregoing, it will be understood that since the metering valve 21 takes the position opening the fuel passageway after the engine continues its full power operation for a considerable time, wastage of fuel due to excess supply of the fuel from the carburetor 11 to the engine is avoided at the beginning of the accelerating operation mode of the vehicle. This fact is effective in preventing incomplete combustion of the air-fuel mixture, which occurs in a gasoline engine provided with the conventional fuel control apparatus, and as a result from the point of view of air pollution conventional defects such as emission of the exhaust gases containing carbon monoxide and unburnt hydrocarbon components is eliminated in accordance with the present invention. The above description was made in connection with the accelerating operation mode of the vehicle from the idling mode, as shown in FIG. 2A. However, if it is assumed that a vehicle having the fuel control apparatus of the present invention is suddenly accelerated from its constant speed drive or that the vehicle must overcome an incline the metering valve 21 will take the position to open the fuel passageway after a predetermined time delay under the sole condition that the full power operation of the gasoline engine continues for a considerably long period. Thus, prevention of waste of the fuel and prevention of emission of the harmful exhaust gases can again be attained.

The foregoing description of the present invention was provided in conjunction with one limitative embodiment shown in FIG. 1 in which the orifice 33 by which the vacuum leaks to the atmosphere is formed in the wall of the vacuum chamber 17. However, it should be understood that the orifice 33 may alternatively be formed in one part of the vacuum pipe line 33*b* or in the housing of the vacuum reservation tank 39. That is, the orifice 33 may be formed in any portion of the vacuum region extending from the vacuum reservation tank 39 to the vacuum chamber 17 without hindering the leakage of the vacuum from the vacuum region. It should also be appreciated that the diameter of the orifice 33 and the stiffness of the spring 31 disposed in the vacuum chamber 17 should be determined in response to the requirements of the delay time for the operation of the metering valve 21 and for the time period during which the metering valve 21 operates to open the fuel passageway between the valve 21 and the valve seat 13*a*.

Figure 3:
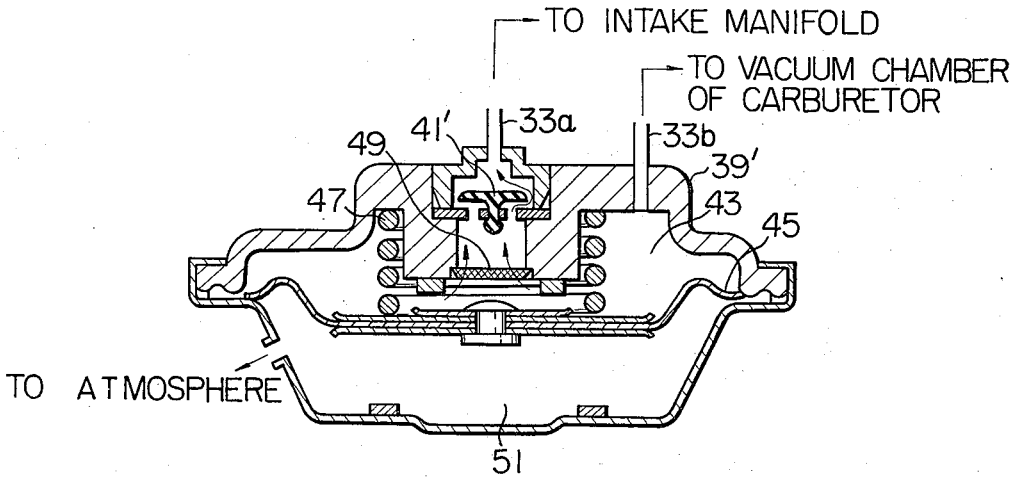
FIG. 3 is a cross-sectional view of an embodiment of a vacuum reservation tank for use in a fuel control apparatus for a carburetor according to the present invention.

The description of one embodiment of the vacuum reservation tank will be provided referring to FIG. 3.

In FIG. 3, a vacuum reservation tank designated by reference numeral 39' is provided with a vacuum reservation chamber 43 and an atmospheric pressure chamber 51 vented to the atmosphere. Reference numeral 41' designates a check valve made of rubber, reference numeral 45 designates a diaphragm serving as a partition between the vacuum reservation chamber 43 and the atmospheric pressure chamber 51, reference numeral 47 designates a coil spring to push the diaphragm 45 in order to maintain a predetermined degree of vacuum in the vacuum reservation chamber 43, and reference numeral 49 designates an air filtering element. In the vacuum reservation tank 39', if the absolute pressure within the vacuum reservation chamber 43 interconnected with the vacuum chamber of a carburetor via the pipe line 33*b* is higher than that in the portion interconnected with an intake manifold via the pipe line 33*a*, the check valve 41' is automatically opened. On the contrary, if the absolute pressure in the vacuum reservation chamber 43 is lower than that in the above-mentioned portion, the check valve 41' is closed.

Another embodiment of the present invention will be explained with reference to FIG. 4. In the embodiment shown in FIG. 4, identical elements or portions of the embodiment in FIG. 1 are designated by the same reference numerals.

Figure 4:
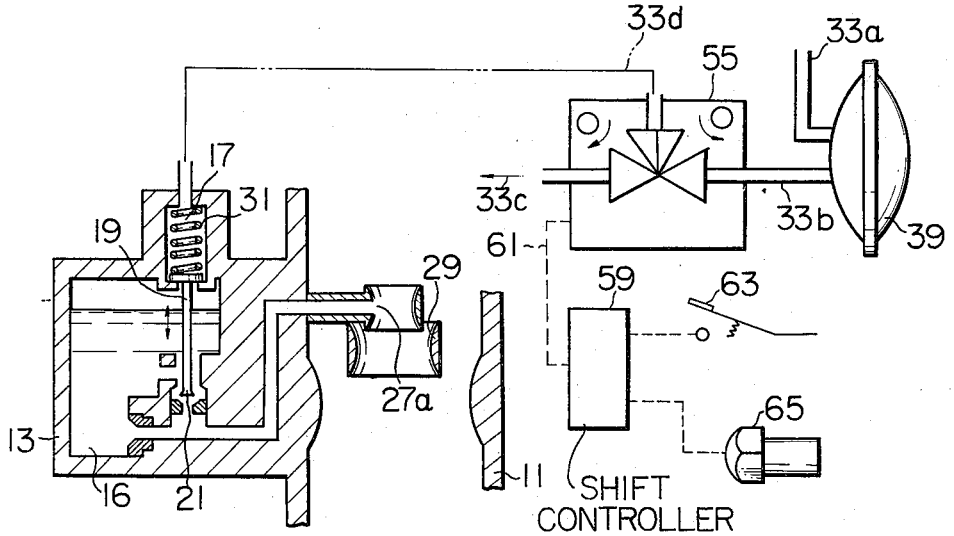
FIG. 4 is a schematic view, in part a cross section, of another embodiment of a fuel control apparatus for a carburetor according to the present invention.

Referring to FIG. 4, it will be noted that the arrangement of this embodiment is different from that of the previous embodiment shown in FIG. 1 in that a three way valve 55 is provided between the vacuum reservation tank 39 and the vacuum chamber 17 of the carburetor 11. That is to say, the vacuum chamber 17 is provided with two vacuum circuits alternately shiftable to one another, one of the two vacuum circuits extending from the chamber 17 to the vacuum reservation tank 39 via a vacuum pipe line 33*d*, the three way valve 55, and a vacuum pipe line 33*b*, the other extending from the chamber 17 to the intake manifold (not shown in FIG. 4) via the vacuum pipe line 33*d*, the three way valve 55 and a vacuum pipe line 33*c*. It should be understood that the three way valve 55 is provided for shifting one vacuum circuit to the other circuit. Of course, the vacuum pipe line 33*a* connecting the intake manifold and the vacuum reservation tank 39 via the check valve (not shown) is arranged similar to the embodiment of FIG. 1. Thus, it is repeated that in the embodiment of FIG. 4, one vacuum circuit directly interconnecting between the intake manifold and the vacuum chamber 17 of the carburetor 11 and the other vacuum circuit interconnecting between the intake manifold and the vacuum chamber 17 by way of the vacuum reservation tank 39 can alternately be established due to the shift of the three way valve 55. Further, it should be appreciated that the embodiment of FIG. 4 is so arranged that the shift of the three way valve 55 is actuated by a shift controller 59 connected to the three way valve 55 by means of an electric signal line 61. Thus, if the three way valve 55 is constituted by the known electromagnetic valve, an electric control signal transmitted from the shift controller 59 actuates the three way valve 55 so that one of the above-mentioned two vacuum circuits may be selected. Consequently, if an embodiment similar to that of FIG. 4 is adopted for the gasoline engine of a vehicle, the transmission of the control signal from the shift controller 59 may be made to occur at the time a selected operation of the vehicle takes place, for example, acceleration. That is, in the arrangement of FIG. 4, if an accelerator pedal 63 of the vehicle is fully depressed so that the throttle valve of the carburetor 11 is widely opened, or if a temperature sensing element 65 detects that the temperature of the engine, e.g. the temperature of cooling water for the engine, falls below a predetermined value (e.g. 50° centigrade of the cooling water), the shift controller 59 transmits the control signal to actuate the shift of the three way valve 55 so that a vacuum circuit directly interconnecting the intake manifold and the vacuum chamber 17, via the vacuum pipe lines 33*c* and 33*d*, is established. On the contrary, if the accelerator pedal 63 is only partly depressed, and if the temperature of the cooling water for the gasoline engine is detected to be at, or more than 50° centigrade, the three way valve 55 is shifted so that a vacuum circuit interconnecting the intake manifold and the vacuum chamber 17 by way of the vacuum pipe line 33*a*, the vacuum reservation tank 39, the three way valve 55 and the vacuum pipe line 33*d* is established. In the above arrangement, the full depression of accelerator pedal 53 so as to open the throttle valve wide, is required for the operation mode of the vehicle such that the engine must immediately be supplied with a full amount of fuel or a rich air-fuel mixture. Such urgent acceleration may be necessary on a steep road or in case of an emergency to avoid a traffic accident. When the throttle valve of the carburetor 11 is widely opened, the vacuum in the intake manifold is immediately reduced. Thus, the vacuum in the vacuum chamber 17 which is placed in a direct interconnection with the intake manifold is also immediately reduced. As a result, the metering valve 21 opens the fuel passageway between the valve 21 and the valve seat 13*a* without any timing delay, so that the amount of fuel supplied to the air horn of the carburetor 11 through the main nozzle 27*a* is increased. Further, the case where the temperature sensing element 65 has detected that the temperature of the cooling water is below the predetermined value (i.e. 50° centigrade), indicates that the engine has not yet warmed up. Therefore it is required that an enriched air-fuel mixture be supplied to the gasoline engine so as to enable smooth operation of said engine. In order to satisfy this requirement, a direct interconnection between the intake manifold and the vacuum chamber 17 of the carburetor 11 is established so that the reduction in the vacuum in the intake manifold due to the opening of the throttle valve is immediately accompanied without any delay in timing, so as to enable the operation of the metering valve 21 which opens the fuel passageway between the valve 21 and the seat 13*a*.

In the embodiment of FIG. 4, the shift controller 59 may preferably be constituted by an electro-magnetic relay, since an electro-magnetic relay is a commerically available and simple electric element. Of course, an appropriate transistor or integrated circuit will be employable for enabling transmission of the shift control signal of the three way valve 55 during the many operation modes of the vehicle. The temperature sensing element 65 may preferably be constituted by a known thermowax switch. In this connection, controlling the amount of fuel supplied from the carburetor, through detecting the temperature of the cooling water will increase the utility of the present invention in the case where a gasoline engine provided with the fuel control apparatus of the present invention is used in a place where the temperature difference between summer and winter is appreciably large.

From the foregoing description with reference to the two embodiments of the present invention, it will be understood that the present invention provides such advantages as a rise in the specific fuel consumption of a gasoline engine, a substantial elimination of carbon monoxide and unburnt hydrocarbon components from the exhaust gases, and attainment of the fuel control adapted for the operation condition of the engine or the environmental condition in which the engine operates.

What is claimed is:

1. Apparatus for controlling the flow of fuel to an internal combustion engine having an intake manifold for delivering a mixture of fuel and air to a combustion space of the engine; a carburetor mounted on the intake manifold, the carburetor having a float chamber, fuel nozzles, a passageway connecting the float chamber to the fuel nozzles, valve means in the passageway for controlling the flow of fuel from the float chamber to the fuel nozzles, a vacuum chamber, and means for varying the opening of the valve means as a direct function of the absolute pressure in the vacuum chamber; and an accelerator pedal for controlling the flow of fuel and air mixture to the engine; the apparatus being of the type that includes a vacuum reservation tank, a first vacuum line for connecting the vacuum reservation tank to an intake manifold of an engine, a second vacuum line for connecting the vacuum reservation tank to a vacuum chamber of a carburetor, valve means for interrupting the connection through the first vacuum line when the absolute pressure in the intake manifold of the engine is higher than the absolute pressure in the vacuum reservation tank, and means for reducing the vacuum in the vacuum chamber of the carburetor at an adjusted slow rate when the engine is accelerating, wherein the improvement comprises:

a three-way valve disposed in the second vacuum line between the vacuum reservation tank and the vacuum chamber of the carburetor;

a third vacuum line connecting the three-way valve to the intake manifold of the engine; and means for shifting the three-way valve between a first vacuum circuit that connects the vacuum reservation tank to the vacuum chamber of the carburetor to a second vacuum circuit that connects the intake manifold of the engine to the vacuum chamber of the carburetor.

2. The fuel control apparatus of claim 1 wherein said three-way valve is an electromagnetic valve, and said means for shifting the three-way valve comprises means for transmitting an electrical control signal to the valve.

3. The fuel control apparatus of claim 1 wherein said means for shifting the three-way valve comprises:

a signal generator for generating a signal in response to an accelerator pedal of the engine being fully depressed and means for actuating said valve in response to said signal to shift from the first vacuum circuit to the second vacuum circuit.

4. The fuel control apparatus of claim 1 wherein said means for shifting the three-way valve comprises:

a temperature sensing element for generating a signal when the temperature of the engine is less then a predetermined value and means for actuating said valve in response to said signal to shift from the first vacuum circuit to the second vacuum circuit.

* * * * *